US010612285B1

(12) United States Patent
Vanatta et al.

(10) Patent No.: US 10,612,285 B1
(45) Date of Patent: Apr. 7, 2020

(54) VEHICLE DOOR HINGE AND TEMPORARY DOOR CHECKER

(71) Applicant: Honda Motor Co., Ltd., Tokyo (JP)

(72) Inventors: Jason Scot Vanatta, Milford Center, OH (US); Christopher Timothy Lynn Bowin, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/361,490

(22) Filed: Mar. 22, 2019

(51) Int. Cl.
*E05D 11/10* (2006.01)
*E05F 5/02* (2006.01)
*E05F 1/12* (2006.01)

(52) U.S. Cl.
CPC ..... *E05D 11/1042* (2013.01); *E05F 1/1238* (2013.01); *E05Y 2900/531* (2013.01)

(58) Field of Classification Search
CPC ..... E05Y 2900/531; E05Y 2201/224; Y10T 16/61; E05D 5/062; E05D 11/1042; E05D 11/1057; E05D 11/1085; E05F 1/1238
See application file for complete search history.

(56) References Cited

U.S. PATENT DOCUMENTS 3,889,316 A * 6/1975 Koike ..... E05D 11/1042 16/297
4,285,098 A * 8/1981 Hicks ..... E05D 11/1042 16/308
4,932,101 A * 6/1990 Lualdi ..... E05D 7/1044 16/255
7,430,785 B2 * 10/2008 Brown ..... E05D 11/1042 16/286
7,469,446 B1 * 12/2008 Brown ..... E05D 11/00 16/334
7,585,013 B2 * 9/2009 Brown ..... E05D 11/1042 16/86 C
7,735,195 B2 * 6/2010 Brown ..... E05D 11/1042 16/286
7,849,561 B2 * 12/2010 Brown ..... E05D 11/1042 16/286
7,921,514 B2 * 4/2011 Anillo Crespo ..... E05D 5/12 16/266

(Continued)

FOREIGN PATENT DOCUMENTS

DE 19811108 2/1999
DE 20220031 2/2003

(Continued)

*Primary Examiner* — Chuck Y Mah
(74) *Attorney, Agent, or Firm* — Rankin, Hill & Clark LLP

(57) ABSTRACT

A hinge system includes a pillar hinge bracket connected to a door hinge bracket by a hinge pin. The pillar hinge bracket is secured to a vehicle body. The door hinge bracket is secured to a vehicle door. A checking device removably secured to the pillar hinge bracket and the door hinge bracket includes a spring portion and a pin portion. The spring portion biases the door hinge bracket to a first position and, in turn, the vehicle door to a fully open position. The pin portion has a first mounting post that secured to the pillar hinge bracket and a second mounting post that is received in an open-sided notch of the door hinge bracket. A ledge partially surrounding the second post includes a stepped portion to prevent unseating of the checking device as the door hinge bracket is caused to move relative to the pillar hinge bracket.

20 Claims, 9 Drawing Sheets

(56) References Cited

U.S. PATENT DOCUMENTS

| | | | | |
|---|---|---|---|---|
| 7,946,017 | B2 | 5/2011 | Brown et al. | |
| 2003/0140455 | A1 * | 7/2003 | Audisio | E05C 21/005 16/334 |

FOREIGN PATENT DOCUMENTS

| | | |
|---|---|---|
| EP | 1522665 | 4/2005 |
| EP | 1540121 | 6/2005 |
| FR | 2657112 | 7/1991 |

* cited by examiner

VEHICLE DOOR HINGE AND TEMPORARY DOOR CHECKER

BACKGROUND

During the manufacture and assembly of vehicles, it is often necessary to perform certain operations with the vehicle body and doors assembled. Automated application of sealer to body joints and door joints and painting of the vehicle are examples of such operations. Concurrent door and body painting provides uniform color and quality between the body and doors. During the sealing and painting operations, the vehicle door is typically opened and closed numerous times. Because the painting, etc. is often performed by automated systems, position and repeatability of locating the doors is of primary importance.

Door hinges used on the finished vehicle may also be used during these intermediate assembly steps such as painting. However, the permanent door checking devices used on the finished vehicle typically are not in place during these intermediate steps because they can be damaged by the harsh environment in paint operations (ovens, paint, use of electrostatic equipment, solvents, and/or preparatory cleaners). As a substitute, temporary door checking devices are used to hold doors in desired positions during these intermediate steps. Typically, a temporary checking device is affixed to the door and vehicle body before the operation begins and removed after the operation is complete and often reused.

BRIEF DESCRIPTION

According to one aspect, a hinge system for mounting a vehicle door on a vehicle body comprises a pillar hinge bracket and a door hinge bracket. The pillar hinge bracket is adapted to be secured to the vehicle body and defines first and second mounting holes. The door hinge bracket is adapted to be secured to the vehicle door and is movable between a first position relative to the pillar hinge bracket where the vehicle door is in a fully open position and a second position relative to the pillar hinge bracket where the vehicle door is in a closed position. The hinge bracket includes an open-sided notch. A hinge pin extends through and interconnects the pillar hinge bracket and the door hinge bracket. A checking device is removably secured to the pillar hinge bracket and the door hinge bracket. The checking device includes a spring portion and a pin portion. The spring portion is connected between the pillar hinge bracket and the door hinge bracket. The spring portion biases the door hinge bracket to the first position and, in turn, the vehicle door to the fully open position. The pin portion has a first mounting post that extends through the first and second mounting holes to secure the checking device to the pillar hinge bracket and a second mounting post that is received in the open-sided notch of the door hinge bracket. A ledge at least partially surrounds the second post and engages a flange of the door hinge bracket that partially surrounds the open-sided notch. The ledge includes a stepped portion to prevent unseating of the checking device as the door hinge bracket is caused to move relative to the pillar hinge bracket.

According to another aspect, a checking device is used with a hinge that mounts a vehicle door on a vehicle body. The hinge includes a pillar hinge bracket adapted to be secured to the vehicle body, a door hinge bracket adapted to be secured to the vehicle door, and a hinge pin interconnecting the pillar hinge bracket and the door hinge bracket.

The checking device comprises a spring portion and a pin portion. The spring portion is releasably connected between the pillar hinge bracket and the door hinge bracket. The spring portion biases the door hinge bracket relative to the pillar hinge bracket to maintain the vehicle door in a fully open position. The pin portion has a first mounting post to secure the checking device to the pillar hinge bracket and a second mounting post to secure the checking device to the door hinge bracket. The pin portion further includes a ledge having a contact surface for engaging a flange of the door hinge bracket. The contact surface is provided with a stepped portion shaped to provide a swing clearance for the door hinge bracket to prevent unseating of the checking device as the door hinge bracket is caused to move relative to the pillar hinge bracket.

According to another aspect, a method for releasably holding a vehicle door mounted on a vehicle body to a fully open position, comprising the steps of providing a hinge system comprising a door hinge bracket, a pillar hinge bracket, and a hinge pin rotatably connecting the brackets to one another; affixing the door to the door hinge bracket; affixing the pillar hinge bracket to a vehicle pillar; releasably connecting a checking device between the door hinge bracket and the pillar hinge bracket, the checking device including a spring portion and a pin portion having a first mounting post, a second mounting post and a ledge adjacent the second mounting post having a contact surface, wherein the connecting step includes: securing the first mounting post to the pillar hinge bracket, securing the second mounting post to the door hinge bracket, positioning the contact surface on a horizontal flange of the door hinge bracket, providing a swing clearance for a transition area from the flange to a vertical bridge member of the door hinge bracket to prevent unseating of the second mounting post as the door hinge bracket is caused to move relative to the pillar hinge bracket, and compressing the spring portion by movement of the vehicle door from the fully open portion to return the vehicle door to the fully open position.

DETAILED DESCRIPTION

Figure 27:
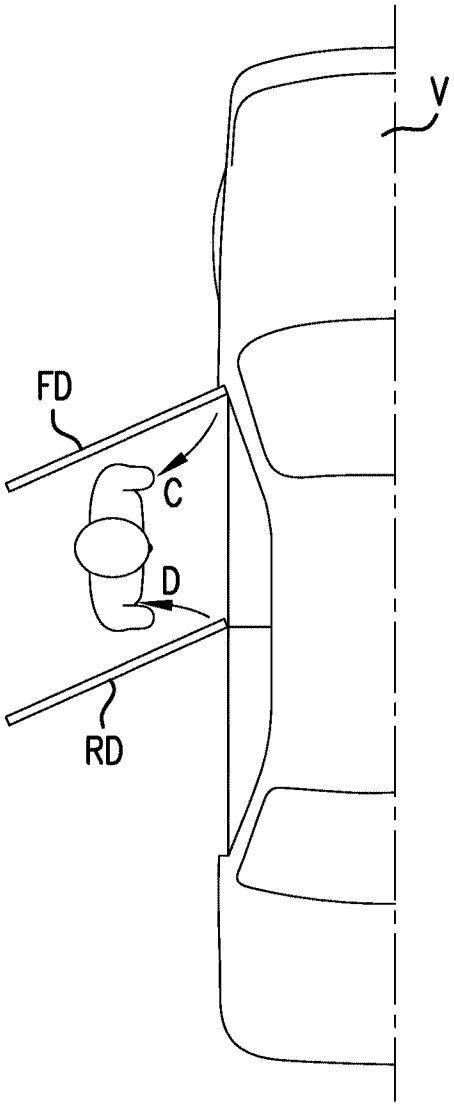
FIG. 27 schematically illustrates a procedure for removal of the front and rear checking devices.
Figure 26:
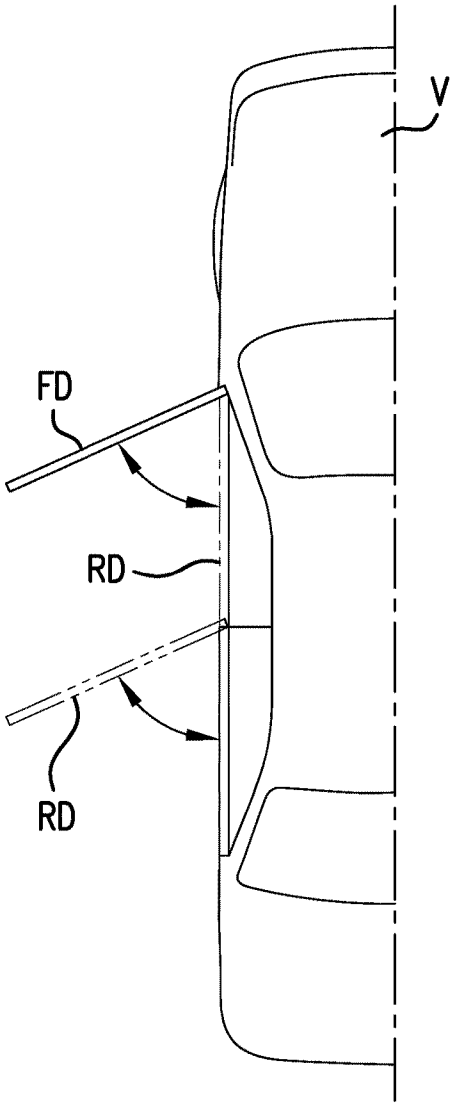
FIG. 26 schematically illustrates movement of the front and rear doors following installation of the front and rear checking devices.
Figure 25:
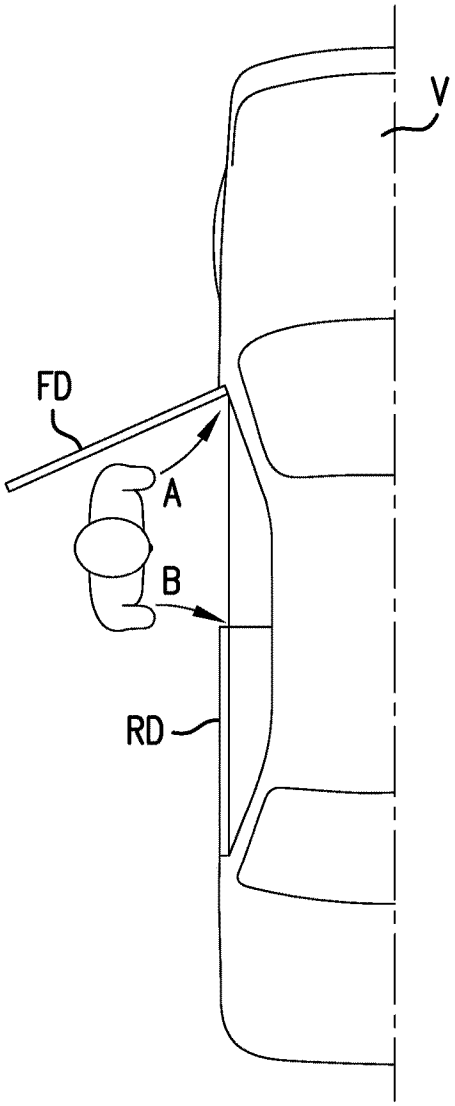
FIG. 25 schematically illustrates a procedure for installation of the front and rear checking devices.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 1-5 illustrate a vehicle hinge 100 for installation on a vehicle front door FD (FIGS. 25-27). The hinge 100 includes a door hinge bracket 102, a pillar hinge bracket 104 and a hinge pin 106. As depicted, a temporary front checker or checking device 108 is mounted to the hinge 100. It should be appreciated that the hinge 100 can be used as both an upper hinge and a lower hinge to pivotally secure the front door to a vehicle body. Alternatively, the hinge 100 may be used as one of the hinges (i.e., upper or lower hinge), while the other hinge is substantially identical, but without the front checking device 108. It is further noted that the hinge 100 is fully functional as a hinge following removal of the front checking device 108.

The door hinge bracket 102 is rotatably secured to the pillar hinge bracket 104 via the hinge pin 106 and is movable between a first position relative to the pillar hinge bracket where the vehicle front door is in a fully open position and a second position relative to the pillar hinge bracket where the vehicle door is in a fully closed position. The angular orientation of the door hinge bracket 102 and the vehicle front door secured thereto may be checked or releasably maintained in the two positions, either fully open or fully closed, via the front checking device 108. The hinge 100 is adapted for use during intermediate vehicle assembly, for example, during a painting operation wherein the vehicle front doors are typically moved between the fully open position and the fully closed position. However, the present disclosure can be used to maintain the front doors in positions that are not literally "fully open" or "fully closed", by, for example, adjustment of the front checking device 108 mounting locations on the hinge 100.

With reference to FIGS. 1-5, the door hinge bracket 102, which is secured to the front door, includes a first or upper mounting flange 120 extending vertically upward and a second or lower mounting flange 122 extending vertically downward. Each mounting flange 120, 122 defines a hole 126, 128 for the passage of a fastener to affix the door hinge bracket 102 to the vehicle front door. A first or upper planar flange 134 is integrally formed with the first mounting flange 120 and extends generally perpendicular thereto. A second or lower planar flange 136 is integrally formed with the second mounting flange 122 and extends generally perpendicular thereto. Each flange 134, 136 defines a hole 138, 140 through which the hinge pin 106 extends.

The lower flange 136 of the door hinge bracket 102 includes an extending portion 142 that extends outwardly opposite the second mounting flange 122. A mounting recess 146 is formed in a lateral surface of the extending portion 142. The mounting recess 146 is semi-circular or arcuate in shape (i.e., an open-sided notch), and is sized to receive a lower portion of the front checking device 108. It should be appreciated that the mounting recess 146 may, instead of curved or arcuate, have any other peripheral shape that is desired.

A bridge member 148 extends between the upper and lower flanges 134, 136, and thus, serves as a structural support for the door hinge bracket 102. The bridge member 148 protrudes from the upper planar flange 134 at a position adjacent the upper mounting flange 120 and between a rear side of the pillar hinge bracket 104 and front door when the hinge 100 is assembled. It is noted that the bridge member 148 is spaced slightly rearwardly (i.e., toward the mounting flanges 120, 122) from the mounting recess 146.

The pillar hinge bracket 104 is secured to a vehicle front pillar. The pillar hinge bracket 104 is generally L-shaped and includes a pillar flange 150 and a pin bracket 152. The pillar flange 150 has a generally planar base wall 154 from which upper and lower peripheral walls 156, 158 extend. The pillar flange 150 defines two holes 166, 168 that receive fasteners to affix the pillar hinge bracket 104 to the vehicle front pillar. The pin bracket 152 is oriented substantially perpendicular to the pillar flange 150 and includes a base wall 172 integrally extending from the base wall 154 of the pillar flange 150. The upper and lower walls 156, 158 integrally extend to the base wall 172. Further, the upper and lower walls 156, 158 extend past the end of the base wall 172, and each of the upper and lower walls 156, 158 define a hole (not visible) near their distal ends. When the hinge 100 is assembled, the holes defined by the upper and lower walls 156, 158 align and cooperate with the holes 138, 140 formed in the upper and lower flanges 134, 136 of the door hinge bracket 102 to receive the hinge pin 106.

An upper mounting hole 176 is formed in the upper wall 156 and a lower mounting hole 178 is formed in the lower wall 158. The upper and lower mounting holes 176, 178 are vertically aligned with each other. It will be appreciated that, while the upper and lower mounting holes 176, 178 are preferably coaxial, a diameter of the upper mounting hole 176 is substantially smaller than a diameter of the lower mounting hole 178. The mounting recess 146 and the mounting holes 176, 178 of the hinge brackets 102, 104 cooperate to receive the front checking device 108.

The features of the front checking device 108 removably secured to the door hinge bracket 102 and the pillar hinge bracket 104 are best depicted in FIGS. 6-11. The front checking device 108 generally includes a spring portion 180 and a pin portion 182. The spring portion 180 is connected between the door hinge bracket 102 and the pillar hinge bracket 104, and is configured to bias the door hinge bracket to the first position and, in turn, the vehicle door to the fully open position. The depicted spring portion 180 includes first and second U-shaped portions 186, 188.

Figure 1:
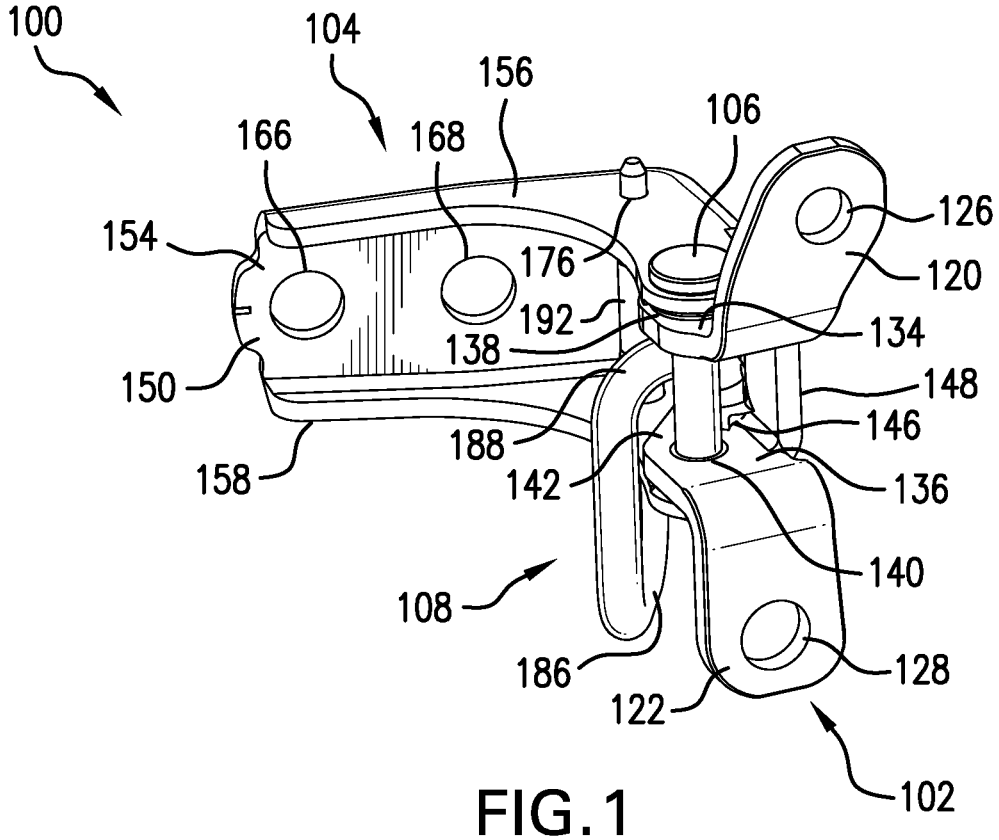
FIG. 1 is a perspective view of a temporary front checking device is used with a vehicle hinge that mounts a vehicle front door on a vehicle body.
Figure 2:
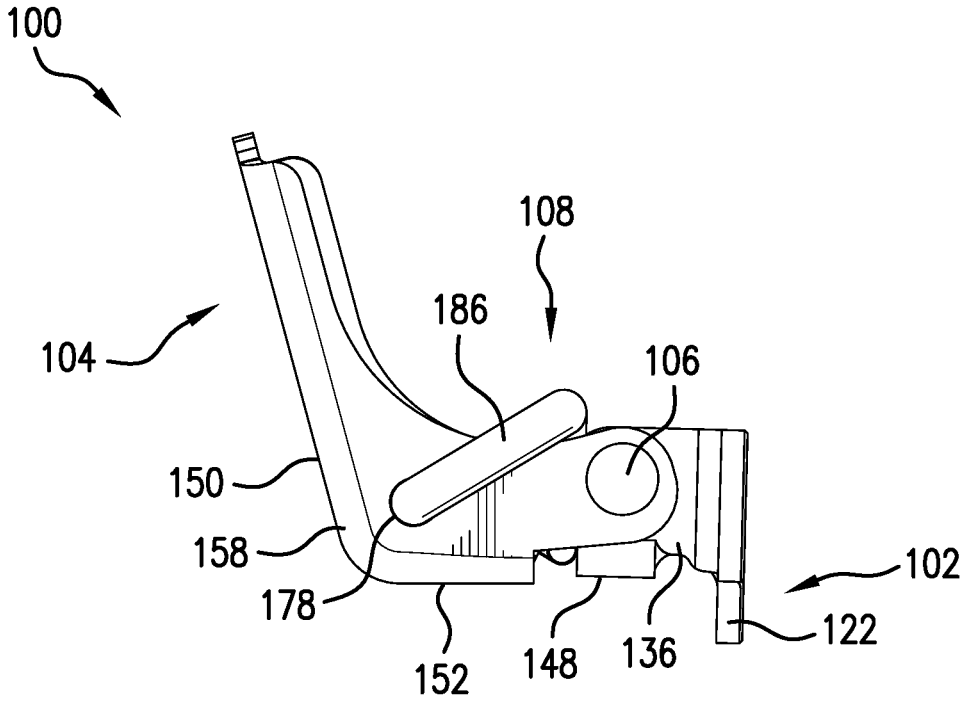
FIG. 2 is a bottom view of FIG. 1.
Figure 3:
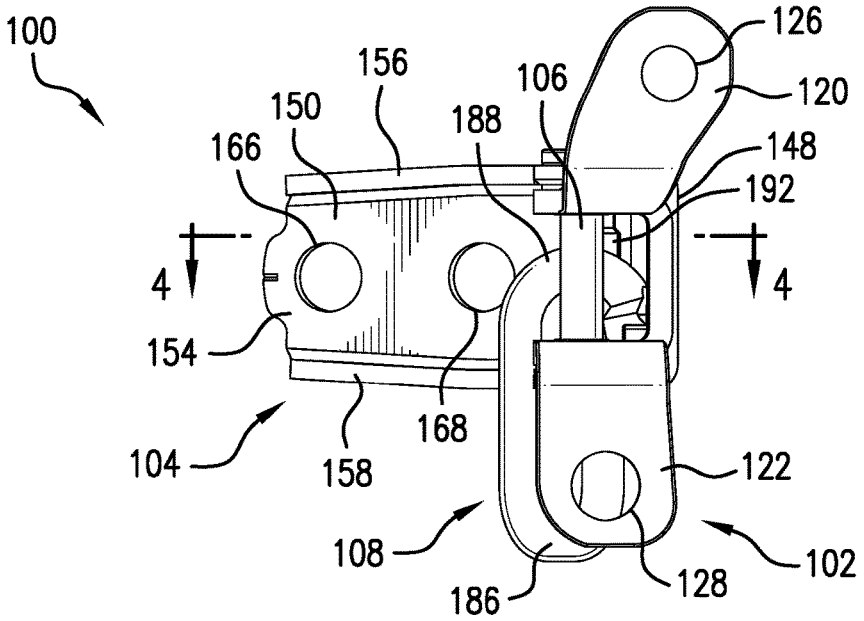
FIG. 3 is a side view of FIG. 1.
Figure 4:
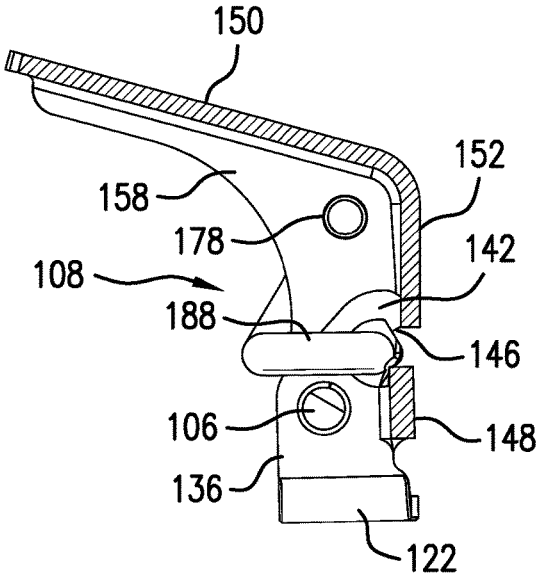
FIG. 4 is a cross-sectional view of FIG. 3 taken along line 4-4 of FIG. 3.

The pin portion 182 includes a first mounting post 192 and a second mounting post 194. The first mounting post 192 includes first, second, and third coaxial segments 200, 202, 204 having first, second and third diameters, respectively. The first segment 200 is at a distal end of the first mounting post 192 and has the smallest diameter of the segments. The first segment 200 is adapted to be received by the upper mounting hole 176 (FIG. 1). When the front checking device 108 is installed in the hinge brackets 102, 104, the second segment 202 is disposed between the upper and lower peripheral walls 156, 158 and the third segment 204 extends through the lower mounting hole 178. The second mounting post 194 is received in the mounting recess 146 (i.e., open-sided notch) of the door hinge bracket 102 (FIG. 4).

Figure 5:
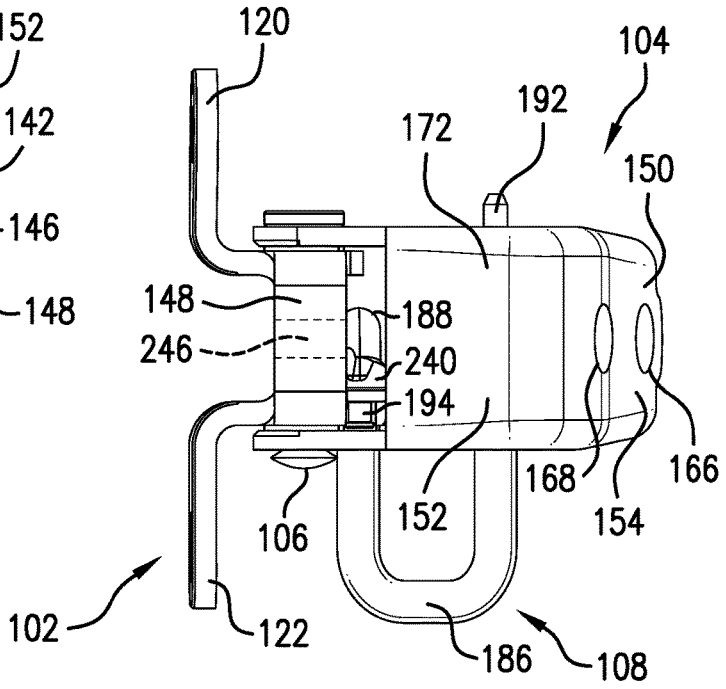
FIG. 5 is a rear view of FIG. 1.
Figure 6:
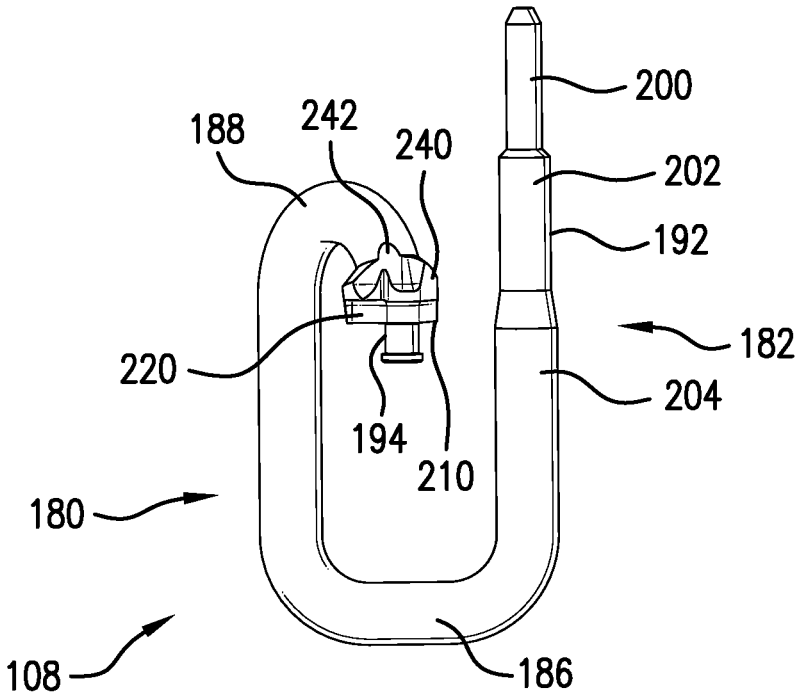
FIG. 6 is a perspective view of the front checking device of FIG. 1.
Figure 7:
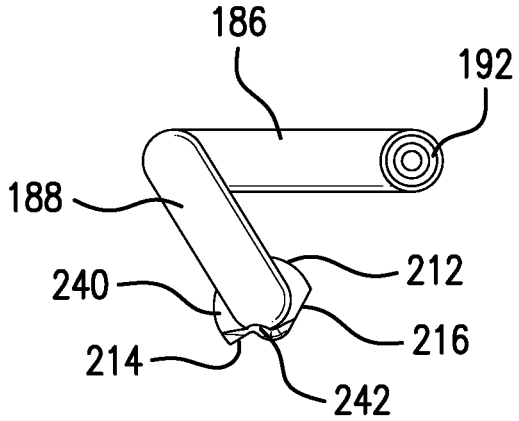
FIGS. 7 and 8 are respective top and bottom views of FIG. 6.
Figure 8:
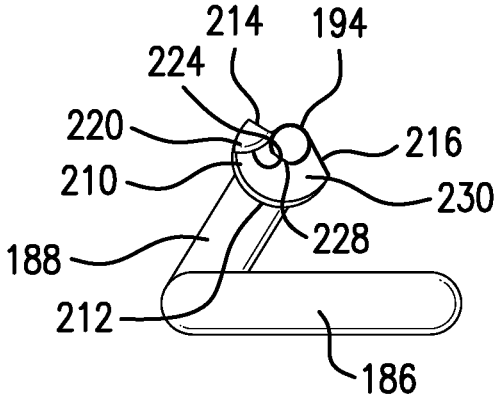
Figure 9:
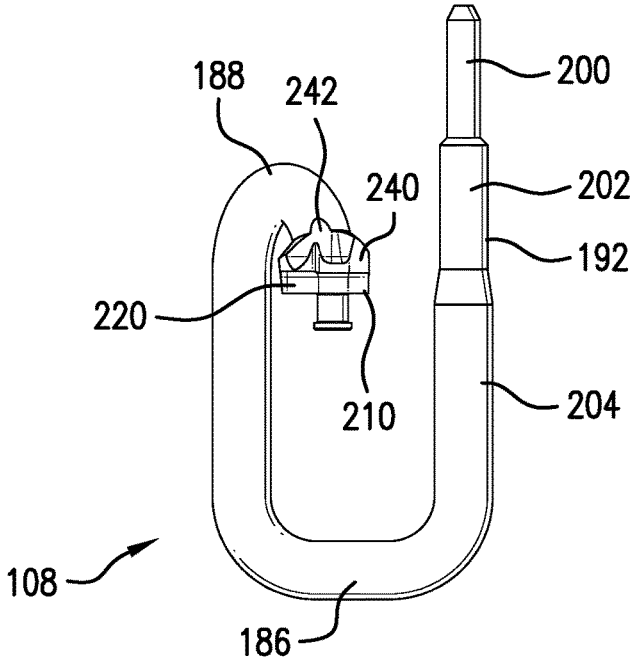
FIG. 9 is a front view of FIG. 6.
Figure 10:
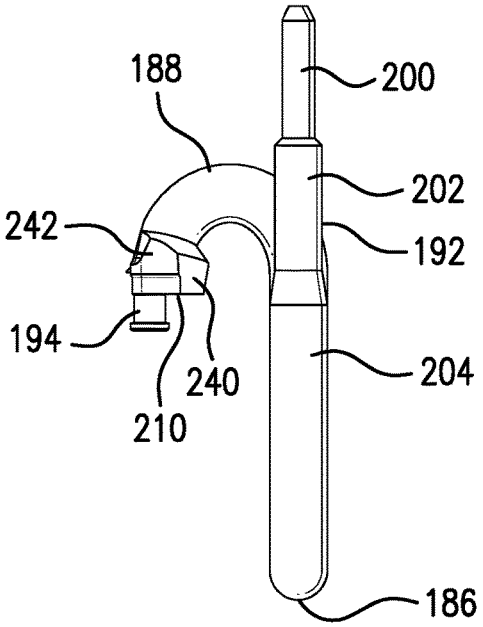
FIGS. 10 and 11 are side views of FIG. 6.
Figure 11:
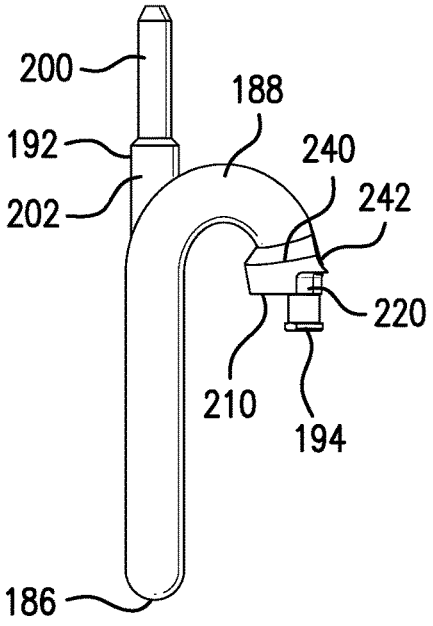

According to the depicted aspect, a ledge 210 at least partially surrounds the second mounting post 194 and directly engages or contacts the second flange 136 of the door hinge bracket 102 that partially surrounds the mounting recess 146 (FIGS. 1 and 5). The ledge 210 can have a circular segment shape in bottom view (FIG. 8), and includes a curved peripheral edge 212 intersecting first and second side edges 214, 216 that are connected to and extend outwardly from the second mounting post 194. The second edge 216 can be canted relative to the first edge 214. Further, the ledge 210 includes a stepped portion 220 (i.e., a notched area) to prevent unseating of the front checking device 108 as the door hinge bracket 102 is caused to move relative to the pillar hinge bracket 104. The stepped portion 220 is provided at one of the first and second edges 214, 216, and in the shown aspect, is provided at the first edge 214. In the depicted aspect, the stepped portion 220 is bounded by the first edge 214, the peripheral edge 212, and a side wall 224 formed in the ledge 210 that spans between the first edge and the peripheral edge. It should be appreciated that the first edge 214 is provided to permit a desired range of motion for the front door relative to the vehicle and to facilitate placement of the second mounting post 194 in close proximity to the bridge member 148. Further, the first edge 214 provides a touch-off on the bridge member 148 which holds the second mounting post 194 into the mounting recess 146 during initial loading of the spring portion 180 as the front door is caused to move from the fully open position.

Further, the second mounting post 194 includes a planar surface 228 which intersects a lower contact surface 230 of the ledge 210. The planar surface 228 allows for ease of install and removal of the second mounting post 194 in the mounting recess 146. As shown, the planar surface 228 faces in a common direction as a maximum extension of the ledge 210 from the second mounting post 194. According to the present disclosure, an enlarged head 240 is provided at a distal end of the second U-shaped portion 188 of the spring portion 180 which transitions toward the ledge 210. The head 240 is provided with a flattened or planar surface 242 adapted to provide transition loading as the door hinge bracket 102 is caused to move relative to the pillar hinge bracket 104. Additionally, a height of the head 240, with the planar surface 242, is sized to avoid contact with a supplier trim tolerance associated with the bridge member 148 of the door hinge bracket 102 as the front door is caused to move from the fully open position. By way of example, it is known for a central portion 246 of the bridge member 148 (i.e., the portion between the first and second flanges 134, 136, FIG. 5) to have a width tolerance of approximately 1.5 mm, and a height of the head 240 is sized to be beneath this central portion 246.

Figure 12:
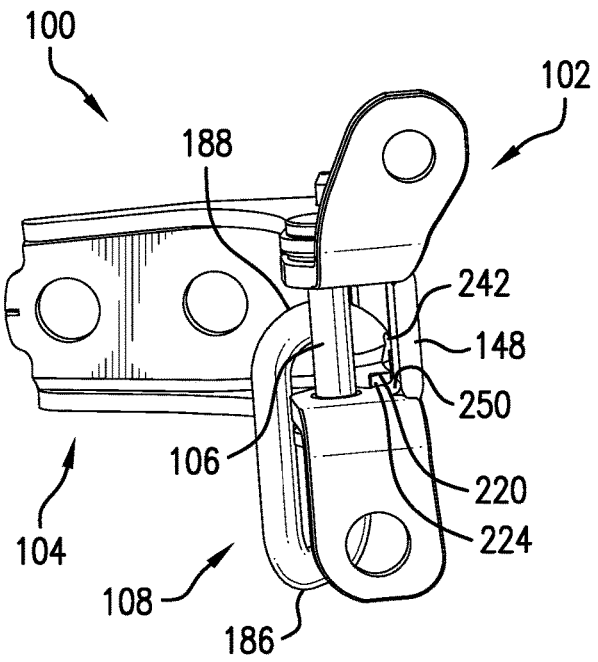
FIGS. 12-15 depict rotation of the vehicle hinge of FIG. 1.
Figure 14:
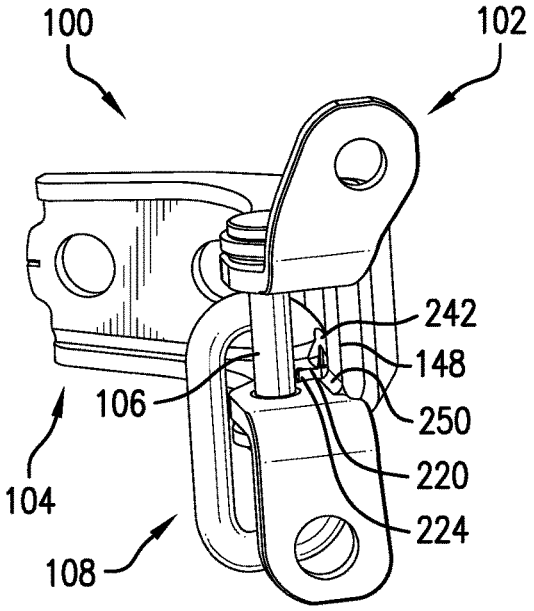
Figure 13:
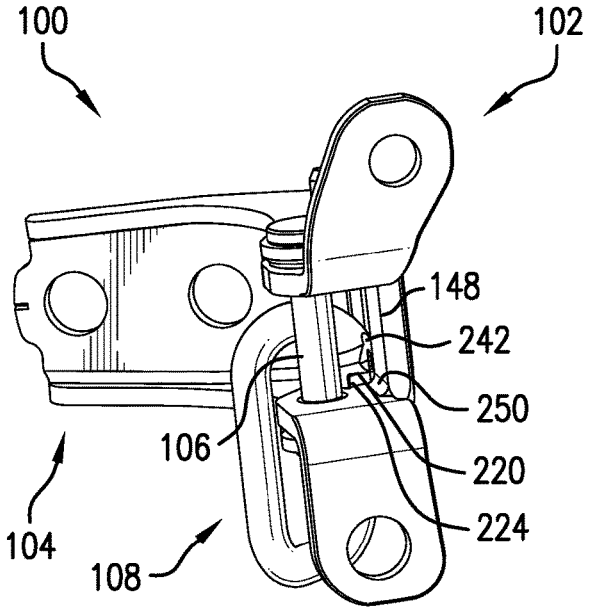
Figure 15:
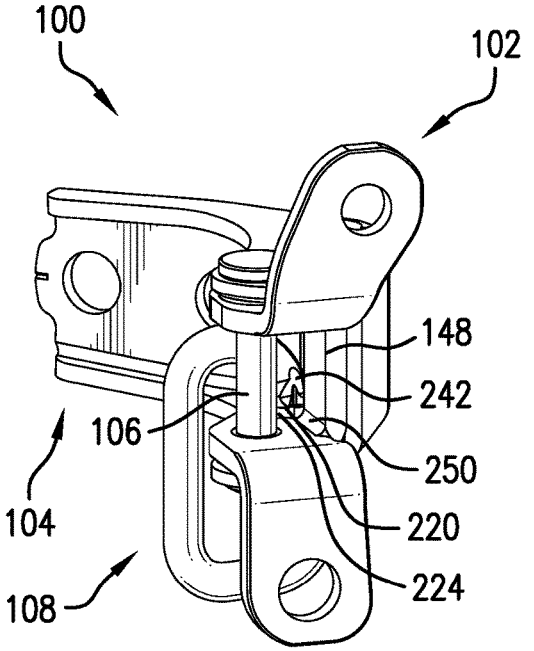

FIGS. 12-15 depict the hinge 100 with the temporary front checking device 108 mounted thereto during movement of the front door from the fully open position (for example, by contact with an obstacle during assembly). In FIG. 12 the front door is in the fully open position. The second mounting post 194 is received in the mounting recess 146 with the stepped portion 220 provided at a transition area 250 between the flange 136 and the bridge member 148 of the door hinge bracket 102. The planar surface 228 on the second mounting post 194 faces into the mounting recess 146. FIGS. 13-15 depict the door hinge bracket 102 moving relative to the pillar hinge bracket 104. The stepped portion 220 provides clearance from the transition area 250 so that the second mounting post 194 remains seated in the mounting recess 146. The side wall 224 of the ledge 210 further provide a swing clearance for the transition area 250 of the door hinge bracket 102. The planar surface 242 provides clearance of the spring portion 180 from the bridge member 148. These features 194, 214, 216, 220, 224, 228, 242 of the front checking device 108 prevent unseating of the front checking device 108 as the door hinge bracket 102 is caused to move relative to the pillar hinge bracket 104, thereby ensuring proper stressing of the first and second U-shaped portions 186, 188, which applies a biasing force on the front door to urge the front door back to the fully open position.

Figure 16:
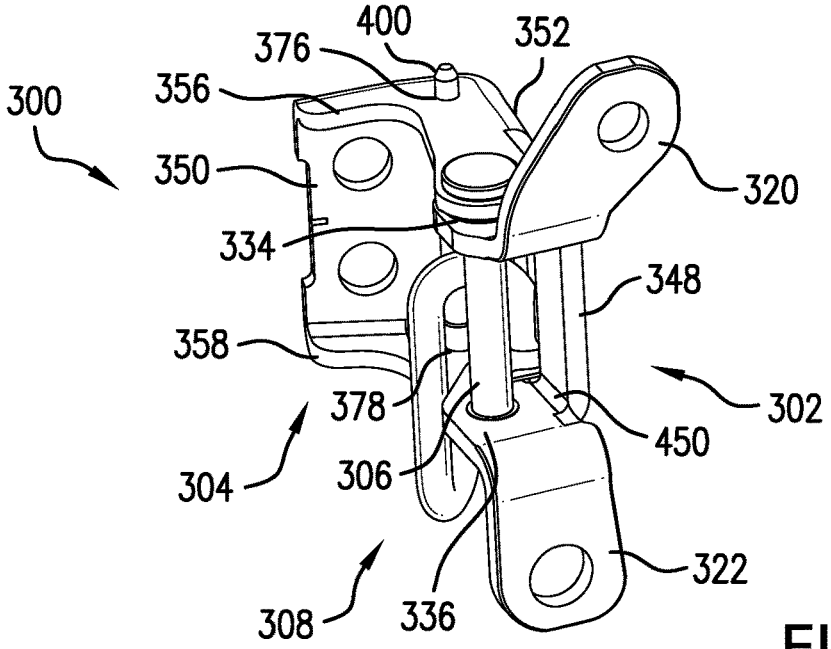
FIG. 16 is a perspective view of a temporary rear checking device is used with a vehicle hinge that mounts a vehicle rear door on a vehicle body.
Figure 17:
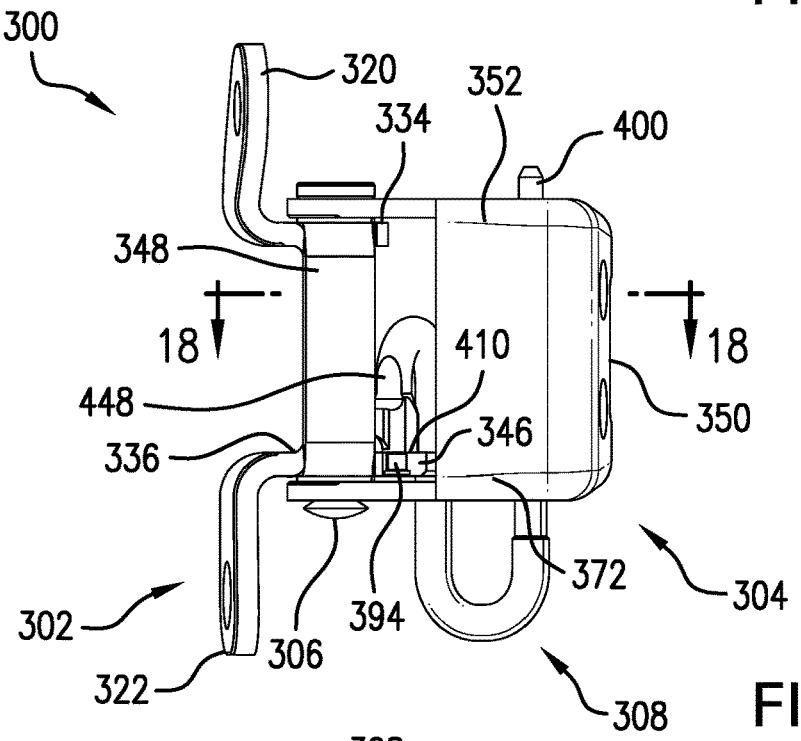
FIG. 17 is a rear view of FIG. 16.
Figure 18:
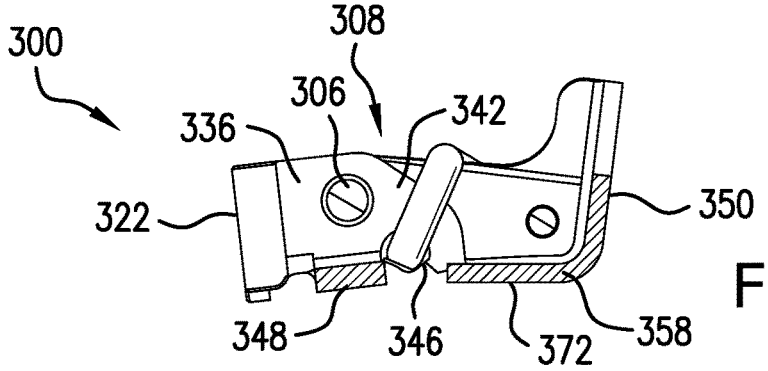
FIG. 18 is a cross-sectional view of FIG. 17 taken along line 18-18 of FIG. 17.

FIGS. 16-18 illustrate a vehicle hinge 300 for installation on a vehicle rear door RD (FIGS. 25-27). Because the hinge 300 is similar to the hinge 100, a detailed description of structural features of the hinge 300 will be omitted for conciseness. The hinge 300 includes a door hinge bracket 302, a pillar hinge bracket 304 and a hinge pin 306. As depicted, a temporary rear checker or checking device 308 is mounted to the hinge 300. The door hinge bracket 302 is rotatably secured to the pillar hinge bracket 304 via the hinge pin 306 and is movable between a first position relative to the pillar hinge bracket where the rear door is in a fully open position and a second position relative to the pillar hinge bracket where the rear door is in a fully closed position. Again, the angular orientation of the door hinge bracket 302 and the rear door secured thereto may be checked or releasably maintained in the two positions, either fully open or fully closed, via operation of the rear checking device 308.

The door hinge bracket 302, which is secured to the rear door, includes a first or upper mounting flange 320, a second or lower mounting flange 322, a first or upper planar flange 334, and a second or lower planar flange 336. Each flange 334, 336 defines a hole through which the hinge pin 306 extends. The lower flange 336 includes an extending portion 342 and a mounting recess 346 (i.e., an open-sided notch) is formed in a lateral surface of the extending portion 342. A bridge member 348 extends between the upper and lower flanges 334, 336.

The pillar hinge bracket 304 is secured to a vehicle rear pillar. The pillar hinge bracket 304 includes a pillar flange 350 and a pin bracket 352. The pillar flange 350 has a generally planar base wall 354 from which upper and lower peripheral walls 356, 358 extend. The pin bracket 352 includes a base wall 372 integrally extending from the base wall 354 of the pillar flange 350. The upper and lower walls 356, 358 integrally extend to the base wall 372. An upper mounting hole 376 is formed in the upper wall 356 and a lower mounting hole 378 is formed in the lower wall 358. The upper and lower mounting holes 376, 378 are vertically aligned with each other. The mounting recess 346 and the mounting holes 376, 378 of the hinge brackets 302, 304 cooperate to receive the rear checking device 308.

The features of the rear checking device 308 removably secured to the door hinge bracket 302 and the pillar hinge bracket 304 are best depicted in FIGS. 19-24. Similar to the front checking device 108, the rear checking device 308 generally includes a spring portion 380 and a pin portion 382. The spring portion 380 is connected between the door hinge bracket 302 and the pillar hinge bracket 304, and is configured to biases the door hinge bracket to the first position and, in turn, the vehicle rear door to the fully open position. The spring portion 380 includes first and second U-shaped portions 386, 388.

The pin portion 382 includes a first mounting post 392 and a second mounting post 394. The first mounting post 392 includes first, second, and third coaxial segments 400, 402, 404 having first, second and third diameters, respectively. The first mounting post 392 is adapted to be received by the upper mounting hole 376 and the lower mounting hole 378 (FIG. 16). The second mounting post 394 is received in the mounting recess 346 (i.e., open-sided notch) of the door hinge bracket 302 (FIG. 18).

Figure 19:
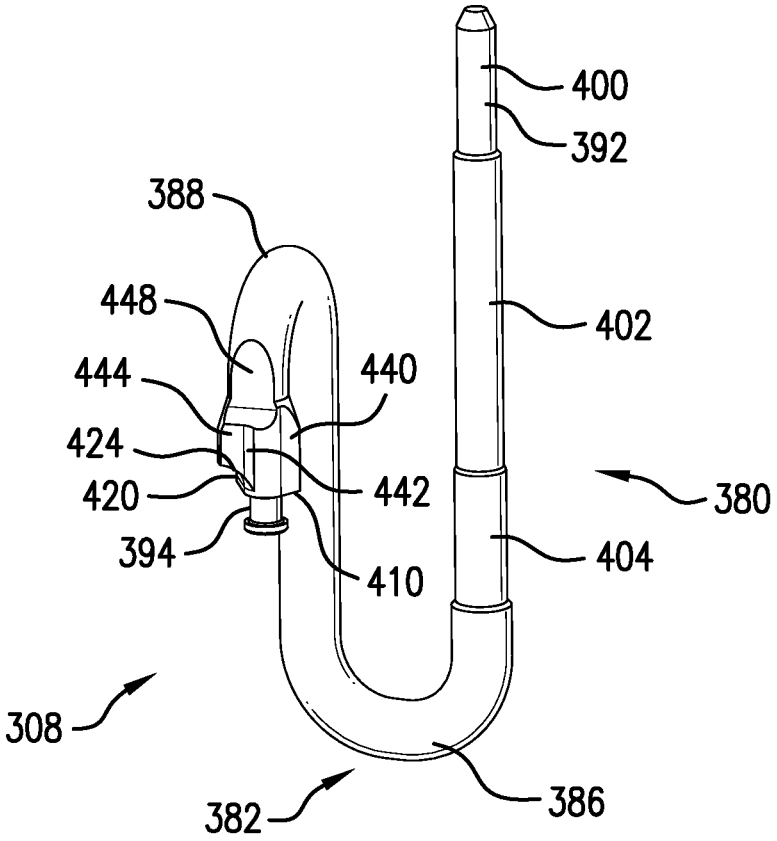
FIG. 19 is a perspective view of the rear checking device of FIG. 16.
Figure 20:
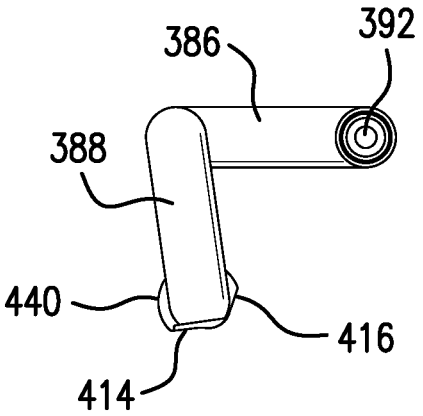
FIGS. 20 and 21 are respective top and bottom views of FIG. 16.
Figure 21:
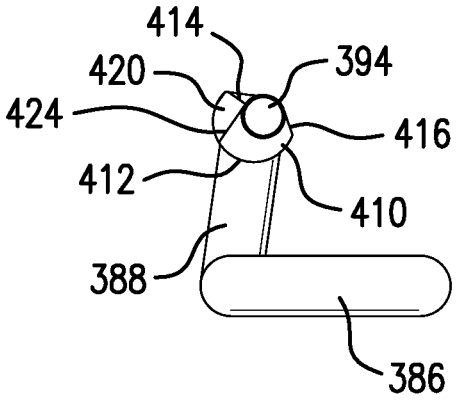
Figure 22:
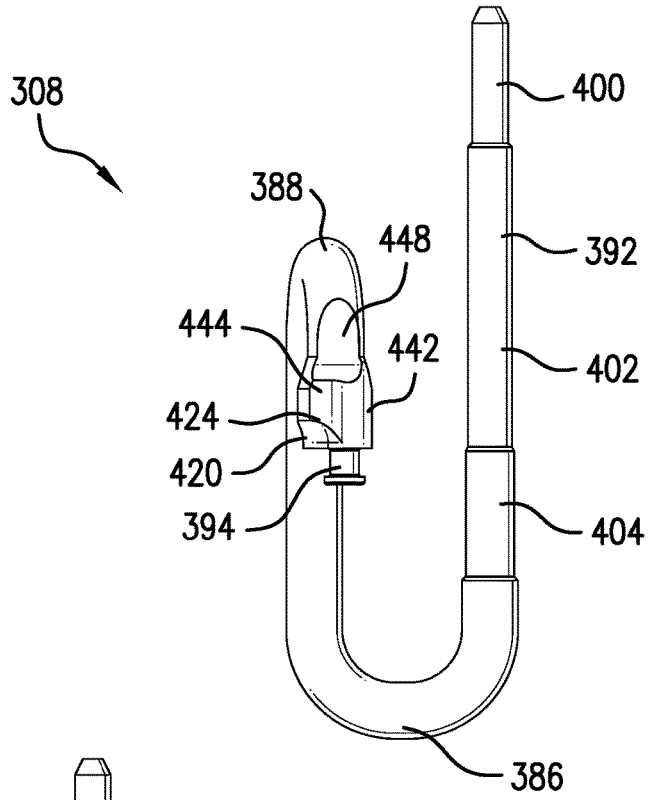
FIG. 22 is a front view of FIG. 16.
Figure 23:
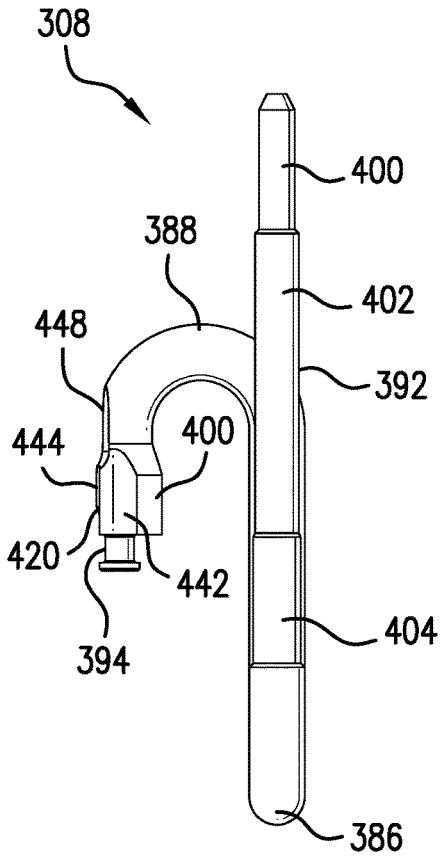
FIGS. 23 and 24 are side views of FIG. 16.
Figure 24:
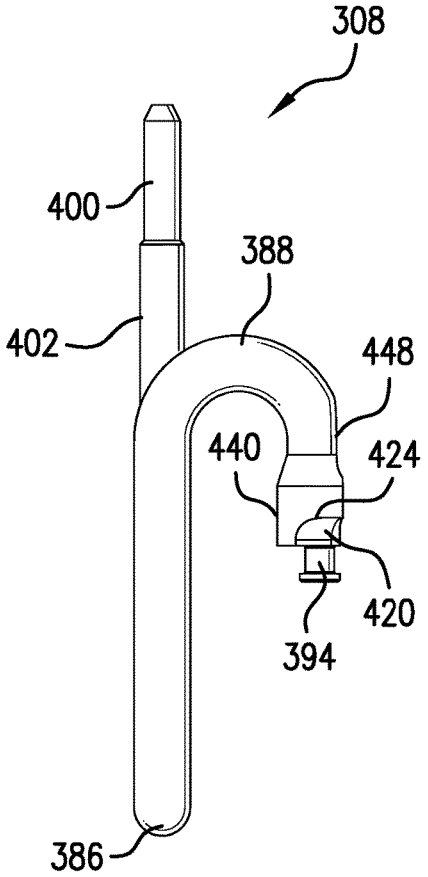

According to the depicted aspect, a ledge 410 at least partially surrounds the second mounting post 394 and directly engages or contacts the second, lower flange 336 of the door hinge bracket 302 that partially surrounds the mounting recess 346 (FIG. 17). Similar to the ledge 210 of the front checking device 108, the ledge 410 can have a circular segment shape in bottom view (FIG. 21), and includes a curved peripheral edge 412 intersecting first and second side edges 414, 416 that are connected to and extend outwardly from the second mounting post 394. The second edge 416 can be canted relative to the first edge 414. Further, the ledge 410 includes a stepped portion 420 (i.e., a notched area) to prevent unseating of the rear checking device 308 as the door hinge bracket 302 is caused to move relative to the pillar hinge bracket 304. The stepped portion 420 is provided at the first edge 414. In the depicted aspect, the stepped portion 420 is bounded by the first edge 414, the peripheral edge 412, and a side wall 424 formed in the ledge 410 that spans between the first edge and the peripheral edge. The side wall 424 can be coved or curved upwardly toward the second U-shaped portion 388 (FIGS. 19 and 22).

According to the present disclosure, an enlarged head 440 is provided at a distal end of the second U-shaped portion 388 of the spring portion 380 which transitions toward the ledge 410. The head 440 is provided with a cutout defined by at least one flattened or planar surface, for example, the depicted first and second flattened or planar surfaces 442, 444. The second planar surface 444 is angled from the first planar surface 442, and the first and second planar surfaces 442, 444 define a V-shape for the cutout. Again, it should be appreciated that a height of the head 440 is sized to avoid contact with a supplier trim tolerance associated with a width dimension of a central portion of the bridge member 348 of the door hinge bracket 302 as the rear door is caused to move from the fully open position. The first and second planar surfaces 442, 444 are adapted to provide transition loading as the door hinge bracket 302 is caused to move relative to the pillar hinge bracket 304. The first and second planar surfaces 442, 444 are further provided to permit a desired range of motion for the rear door relative to the vehicle and to facilitate placement of the second mounting post 394 in close proximity to the bridge member 348. To further allow for the desired range of motion, the distal end of the second U-shaped portion 388 can have another flattened or planar surface 448.

With reference back to FIGS. 16-18, the second mounting post 394 is received in the mounting recess 346 with the stepped portion 420 provided at a transition area 450 between the lower flange 336 and the bridge member 348 of the door hinge bracket 302. The stepped portion 420 provides clearance from the transition area 450 so that the second mounting post 394 remains seated in the mounting recess 346. The side wall 424 of the ledge 410 further provide a swing clearance for the transition area 450 of the door hinge bracket 302. The first and second planar surfaces 442, 444 provide a touch-off on the bridge member 348 which hold the second mounting post 394 into the mounting recess 346 during initial loading of the spring portion 380 as the rear door is caused to move from the fully open position. It should be also be appreciated that the planar surface 448 on the second U-shaped portion 388 also allows the rear checking device 308 to freely rotate past the bridge member 348 as the rear door is moved more toward the fully closed position. These features 394, 420, 424, 442, 444, 448 of the rear checking device 308 prevent unseating of the rear checking device as the door hinge bracket 302 is caused to move relative to the pillar hinge bracket 304, thereby ensuring proper stressing of the first and second U-shaped portions 386, 388, which applies a biasing force on the rear door to urge the rear door back to the fully open position.

FIG. 25 illustrates a condition in which the front and rear vehicle doors FD, RD of the vehicle V are prepared for receipt of the front and rear checking devices 108, 308, respectively. More specifically, the front door is in the fully open position, while the rear door is in the fully closed position. It should be appreciated that opening the front door FD gives access to the rear hinge brackets 302, 304. The front checking device 108 can be installed in the direction of arrow "A" while the rear checking device 308 can be installed in the direction of arrow "B". Thereafter, the vehicle is moved along the assembly line and processed (i.e., sealing and painting operations), with the doors FD, RD being moved between the fully open and fully closed positions, as desired (FIG. 26). It will be appreciated that, due to the biasing forces applied by the front and rear checking devices 108, 308, the front and rear doors can be substantially maintained in their respective positions. With reference to FIG. 27, when the processing operations are completed such that the front and rear checking devices 108, 308 are no longer required, the front and rear checking devices 108, 308 are removed. Removal of the checking devices front and rear checking devices 108, 308 is accomplished by reversing the installation process. More specifically, the front door FD is opened to gain access to the front checking device 108 (arrow "C") and the rear checking device 308 (arrow "D").

As is evident from the foregoing, the present disclosure provides a method for releasably holding a vehicle door mounted on a vehicle body to a fully open position. The exemplary method comprises the steps of providing a hinge system comprising a door hinge bracket, a pillar hinge bracket, and a hinge pin rotatably connecting the brackets to one another; affixing the door to the door hinge bracket; affixing the pillar hinge bracket to a vehicle pillar; releasably connecting a checking device between the door hinge bracket and the pillar hinge bracket, the checking device including a spring portion and a pin portion having a first mounting post, a second mounting post and a ledge adjacent the second mounting post having a contact surface. The connecting step includes securing the first mounting post to the pillar hinge bracket, securing the second mounting post to the door hinge bracket, positioning the contact surface on a horizontal flange of the door hinge bracket, providing a swing clearance for a transition area from the flange to a vertical bridge member of the door hinge bracket to prevent unseating of the second mounting post as the door hinge bracket is caused to move relative to the pillar hinge bracket, and compressing the spring portion by movement of the vehicle door from the fully open portion to return the vehicle door to the fully open position. The connecting step further includes inserting the first mounting post into the mounting hole and inserting the second mounting post into the open-sided notch.

It will be appreciated that the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A hinge system for mounting a vehicle door on a vehicle body, comprising:

a pillar hinge bracket adapted to be secured to the vehicle body, the pillar hinge bracket defines first and second mounting holes;

a door hinge bracket adapted to be secured to the vehicle door and movable between a first position relative to the pillar hinge bracket where the vehicle door is in a fully open position and a second position relative to the pillar hinge bracket where the vehicle door is in a closed position, the hinge bracket includes an open-sided notch;

a hinge pin extending through and interconnecting the pillar hinge bracket and the door hinge bracket; and, a checking device removably secured to the pillar hinge bracket and the door hinge bracket, the checking device including:

a spring portion connected between the pillar hinge bracket and the door hinge bracket, the spring portion biases the door hinge bracket to the first position and, in turn, the vehicle door to the fully open position, and a pin portion having a first mounting post that extends through the first and second mounting holes to secure the checking device to the pillar hinge bracket and a second mounting post that is received in the open-sided notch of the door hinge bracket, a ledge at least partially surrounds the second post, the ledge engaging a flange of the door hinge bracket that partially surrounds the open-sided notch, the ledge including a stepped portion to prevent unseating of the checking device as the door hinge bracket is caused to move relative to the pillar hinge bracket.

2. The hinge system of claim 1, wherein the ledge has a circular segment shape in bottom view.

3. The hinge system of claim 2, wherein the ledge includes a curved peripheral edge intersecting first and second side edges that are connected to and extend outwardly from the second post, the second side edge is canted relative to the first side edge.

4. The hinge system of claim 3, wherein the stepped portion is provided at one of the first and second side edges.

5. The hinge system of claim 4, wherein the stepped portion is shaped to provide clearance from a transition area between the flange and a bridge member of the door hinge bracket as the door hinge bracket is caused to move relative to the pillar hinge bracket.

6. The hinge system of claim 5, wherein the stepped portion is bounded by the one of the first and second side edges, the peripheral edge, and a side wall formed in the ledge that spans between the one side edge and the peripheral edge.

7. The hinge system of claim 6, wherein the side wall of the ledge is shaped to provide a swing clearance for the transition area of the door hinge bracket.

8. The hinge system of claim 1, wherein the ledge includes first and second side edges that extend outwardly from the second post, the first side edge is configured to provide a touch-off on a bridge member of the door hinge bracket which holds the second post into the open-sided notch during initial loading of the spring portion as the vehicle door is caused to move from the fully open position.

9. The hinge system of claim 1, wherein the spring portion includes an enlarged head which transitions toward the ledge, the head includes a planar surface to provide clearance of the spring portion from the door hinge bracket as the door hinge bracket is caused to move relative to the pillar hinge bracket.

10. The hinge system of claim 9, wherein the planar surface is configured to provide a touch-off on a bridge member of the door hinge bracket which holds the second post into the open-sided notch during initial loading of the spring portion as the vehicle door is caused to move from the fully open position.

11. A checking device for use with a hinge that mounts a vehicle door on a vehicle body, the hinge includes a pillar hinge bracket adapted to be secured to the vehicle body, a door hinge bracket adapted to be secured to the vehicle door, and a hinge pin interconnecting the pillar hinge bracket and the door hinge bracket, the checking device comprises:

a spring portion releasably connected between the pillar hinge bracket and the door hinge bracket, the spring portion biases the door hinge bracket relative to the pillar hinge bracket to maintain the vehicle door in a fully open position, and a pin portion having a first mounting post to secure the checking device to the pillar hinge bracket and a second mounting post to secure the checking device to the door hinge bracket, the pin portion further including a ledge having a contact surface for engaging a flange of the door hinge bracket, the contact surface provided with a stepped portion shaped to provide a swing clearance for the door hinge bracket to prevent unseating of the checking device as the door hinge bracket is caused to move relative to the pillar hinge bracket.

12. The checking device of claim 11, wherein the pillar hinge bracket defines mounting holes, and the first mounting post of the checking device is adapted to extend through the mounting holes to secure the spring portion of checking device between the pillar hinge bracket and the door hinge bracket.

13. The checking device of claim 11, wherein the door hinge bracket includes an open-sided notch, and the second mounting post of the checking device is adapted to be received in the open-sided notch.

14. The checking device of claim 11, wherein the spring portion is defined by a first U-shaped portion from which the first mounting post extends and a second U-shaped portion from which the second mounting post extends.

15. The checking device of claim 11, wherein the spring portion includes an enlarged head, the head includes a planar surface adapted to provide transition loading as the door hinge bracket is caused to move relative to the pillar hinge bracket.

16. The checking device of claim 15, wherein the head includes a second planar surface angled from the planar surface, the planar surface and the second planar surface define a V-shaped cutout.

17. The checking device of claim 11, wherein the ledge includes first and second side edges intersecting the second mounting post, and the stepped portion is provided at one of the first and second edges.

18. The checking device of claim 11, wherein the stepped portion is curved upwardly from the second mounting post.

19. A method for releasably holding a vehicle door mounted on a vehicle body to a fully open position, comprising the steps of:

providing a hinge system comprising a door hinge bracket, a pillar hinge bracket, and a hinge pin rotatably connecting the brackets to one another;

affixing the door to the door hinge bracket;

affixing the pillar hinge bracket to a vehicle pillar;

releasably connecting a checking device between the door hinge bracket and the pillar hinge bracket, the checking device including a spring portion and a pin portion having a first mounting post, a second mounting post and a ledge adjacent the second mounting post having a contact surface, wherein the connecting step includes:

securing the first mounting post to the pillar hinge bracket, securing the second mounting post to the door hinge bracket, positioning the contact surface on a horizontal flange of the door hinge bracket, providing a swing clearance for a transition area from the flange to a vertical bridge member of the door hinge bracket to prevent unseating of the second mounting post as the door hinge bracket is caused to move relative to the pillar hinge bracket, and compressing the spring portion by movement of the vehicle door from the fully open portion to return the vehicle door to the fully open position.

20. The method of claim 19, wherein the pillar hinge bracket includes a mounting hole and the door hinge bracket includes an open-sided notch, and the connecting step includes inserting the first mounting post into the mounting hole and inserting the second mounting post into the open-sided notch.

* * * * *